US010233572B2

(12) United States Patent
Rousseau et al.

(10) Patent No.: US 10,233,572 B2
(45) Date of Patent: Mar. 19, 2019

(54) YARN TAKE-UP SYSTEM FOR WEAVING AND A METHOD OF WEAVING A REINFORCING FIBER STRUCTURE FOR COMPOSITE MATERIAL PARTS

(71) Applicant: SNECMA, Paris (FR)

(72) Inventors: Claire Rousseau, Paris (FR); Dominique Michel Serge Magnaudeix, Evry-Gregy-sur-Yerres (FR); Jérémy Hellot, Paris (FR)

(73) Assignee: SNECMA, Paris (FR)

( * ) Notice: Subject to any disclaimer, the term of this patent is extended or adjusted under 35 U.S.C. 154(b) by 222 days.

(21) Appl. No.: 15/196,249

(22) Filed: Jun. 29, 2016

(65) Prior Publication Data

US 2016/0376734 A1 Dec. 29, 2016

(30) Foreign Application Priority Data

Jun. 29, 2015 (FR) ..... 15 56042

(51) Int. Cl.

| | |
|---|---|
| ***D03D 11/00*** | (2006.01) |
| ***D03C 3/20*** | (2006.01) |
| ***D03D 41/00*** | (2006.01) |
| ***D03D 49/04*** | (2006.01) |
| ***D03D 49/12*** | (2006.01) |
| ***D03C 3/12*** | (2006.01) |

(Continued)

(52) U.S. Cl.

CPC ..... *D03D 11/00* (2013.01); *D03C 3/12* (2013.01); *D03C 3/20* (2013.01); *D03C 9/02* (2013.01); *D03D 13/004* (2013.01); *D03D 41/004* (2013.01); *D03D 49/04* (2013.01); *D03D 49/12* (2013.01)

(58) Field of Classification Search

CPC ..... D03D 11/00; D03D 3/20; D03D 13/004; D03D 41/004; D03D 49/04; D03D 49/12; D03C 3/12; D03C 3/20; D03C 9/02

See application file for complete search history.

(56) References Cited

U.S. PATENT DOCUMENTS 3,834,424 A * 9/1974 Fukuta ..... D03D 41/004 139/22
3,920,053 A * 11/1975 Akami ..... D03C 3/20 139/319

(Continued)

FOREIGN PATENT DOCUMENTS

WO WO 2006/136755 A2 12/2006
WO WO 2013/088037 A2 6/2013

OTHER PUBLICATIONS

Search Report as issued in French Patent Application No. 1556042, dated May 9, 2016.

*Primary Examiner* — Andrew W Sutton
(74) *Attorney, Agent, or Firm* — Pillsbury Winthrop Shaw Pittman LLP

(57) ABSTRACT

A warp yarn take-up system includes a clamping device for holding a plurality of layers of warp yarns, the clamping device being movable at least in a direction corresponding to the advance direction of the warp yarns. The clamping device includes a bottom clamp, a top clamp, and at least one intermediate clamping element present between the bottom clamp and the top clamp. The bottom clamp, the top clamp, and the at least one intermediate clamping element are held together by clamping.

10 Claims, 6 Drawing Sheets

(51) Int. Cl.
*D03C 9/02* (2006.01)
*D03D 13/00* (2006.01)

(56) References Cited

U.S. PATENT DOCUMENTS

| | | | | |
|---|---|---|---|---|
| 4,019,540 | A * | 4/1977 | Holman | D03D 41/004 139/20 |
| 8,939,179 | B2 * | 1/2015 | Janicijevic | D03C 13/00 139/1 E |
| 2002/0043290 | A1 * | 4/2002 | Kuwabara | D03D 29/00 139/91 |
| 2003/0217780 | A1 * | 11/2003 | Uchida | D03D 25/005 139/11 |
| 2015/0111457 | A1 * | 4/2015 | Khokar | D04H 3/05 442/366 |
| 2016/0201234 | A1 * | 7/2016 | Khokar | D03C 9/02 139/384 R |

* cited by examiner

YARN TAKE-UP SYSTEM FOR WEAVING AND A METHOD OF WEAVING A REINFORCING FIBER STRUCTURE FOR COMPOSITE MATERIAL PARTS

CROSS-REFERENCE TO RELATED APPLICATIONS

This application claims priority to French Patent Application No. 1556042, filed Jun. 29, 2015, the entire content of which is incorporated herein by reference in its entirety.

FIELD

The present invention relates to making composite material parts and more particularly to making fiber reinforcement for such parts by three-dimensional (3D) or multilayer weaving.

A field of application of the invention is making structural parts out of composite material, i.e. structural parts having fiber reinforcement that is densified with a matrix. Composite materials are used to make parts presenting overall weight that is less than the weight of the same parts when made out of metal material.

BACKGROUND 3D or multilayer weaving of fiber structures for constituting the fiber reinforcement of a composite material part, e.g. such as an aeroengine blade, is performed in a Jacquard type loom, the weaving consisting in inserting weft yarns so as to create a pattern between warp yarns. The warp yarns are organized in the harness of the loom as a plurality of layers and of columns that are manipulated by the loom so as to enable weft yarns to be inserted in compliance with the weaving pattern(s) programmed in the loom. The weft yarns are inserted in columns between the warp yarns.

In order to enable each column of weft yarns to be inserted while weaving the fiber structure, a warp yarn take-up system is associated with the loom. This system, which is located downstream from the loom, serves to hold all of the warp yarns together in a clamping device and to enable the warp yarns to advance through a determined distance after each column of weft yarns has been inserted.

Thus, when beginning new weaving of a fiber structure, it is necessary to clamp the warp yarns downstream from the loom. In addition, in the context of fabricating a series of fiber structures, e.g. fiber structures for forming reinforcement for turbine engine blades, it is necessary for the warp yarns to be clamped between each of the fiber structures.

The clamping device normally used is made up of two clamps 10 and 11, as shown in FIG. 10, with all of the warp yarns 21 that come from the warp yarn layers leaving the loom being held between them. The precise arrangement of the warp yarns or strands in layers and columns as defined in the harness of the loom is then upset in a bundle of disorganized yarns or strands between the clamps 10 and 11.

This disorganization of the warp yarns where they are clamped downstream from the loom leads to undesirable and uncontrolled sliding between the warp yarns, thereby disturbing the weaving within the fiber structure and harming its quality. The thicker the fiber structure, the greater the number of warp yarns and the greater the number of warp yarn layers that are needed for weaving. By way of example, it is necessary to use about 4000 warp yarns arranged in 20 layers in order to weave a fiber structure that is to form the fiber reinforcement of an aeroengine fan blade. The impact of the clamping on disorganizing the warp yarns is increased with increasing number of warp yarn layers.

In order to reduce this impact, the distance between the clamping device and the beginning of the woven fiber structure is increased. Nevertheless, that leads to a significant loss of yarn when cutting the yarns in order to extract the fiber structure, and that loss significantly penalizes the cost of fabrication.

SUMMARY

It is therefore desirable to be able to weave 3D or multilayer fiber structures with high quality weaving while minimizing losses of material.

To this end, an aspect of the invention provides a warp yarn take-up system comprising a clamping device for holding a plurality of layers of warp yarns, the clamping device being movable at least in a direction corresponding to the advance direction of the warp yarns, wherein the clamping device comprises a bottom clamp, a top clamp, and at least one intermediate clamping element present between the bottom clamp and the top clamp, and wherein the bottom clamp, the top clamp, and the intermediate clamping element(s) are held together by clamping.

The use of one or more intermediate clamping elements makes it possible locally to reduce the number of warp yarn layers that are clamped together. Specifically, the plurality of warp yarn layers is subdivided into a plurality of layer subsets, each of which is held between one of the two main clamps and an intermediate clamping element or between two intermediate clamping elements. By limiting the number of layers of warp yarns that are clamped together in this way, it is possible to conserve better the organization of warp yarns as defined upstream in the harness of the loom, and thus improve the quality of the fiber structures that are woven, and in particular the quality of thick fiber structures.

According to a particular characteristic of the system of the invention, the bottom clamp, the top clamp, and the intermediate clamping element(s) include one or more portions for coming into contact with the warp yarns during clamping of the clamping device, and each of these portions is covered in a layer of soft material. This avoids damaging the warp yarns while they are being clamped, while continuing to fit closely to the shape of the fiber structure so as to facilitate clamping. The soft material may in particular be selected from at least of the following materials: elastomer, rubber, silicone, copolymer.

An embodiment of the invention also provides a Jacquard type loom, characterized in that it includes a warp yarn take-up system of the invention.

An aspect of the invention also provides a method of fabricating at least one fiber structure by three-dimensional or multilayer weaving between a plurality of layers of warp yarns interlinked by weft yarns, the method including the steps of:

clamping warp yarn layers by clamping a clamping device of a warp yarn take-up system of the invention, each intermediate clamping element being inserted between two adjacent layers of the plurality of warp yarn layers so as to separate a fraction of the warp yarn layers in the plurality of warp yarn layers from the remaining layers of the plurality of warp yarn layers in the clamping device; and weaving a first fiber structure upstream from the clamping device, the clamping device being moved in an advance direction of the warp yarns during the weaving.

It is thus possible to weave a fiber structure, even a thick structure, while conserving the overall organization of the warp yarns as defined upstream in the harness of the loom, and thus obtain woven fiber structures that are of good quality.

In an aspect of the method of the invention, a second fiber structure is woven using the same plurality of weft yarn layers as is used in the first fiber structure, a non-woven portion of warp yarns lying between the two fiber structures, the clamping device then being put into place on the non-woven portion. Since the clamping device used herein upsets the organization of warp yarns defined in the harness of the loom little or not at all, it is possible to minimize the length of the non-woven portion, and consequently to reduce the loss of material constituting the warp yarns, where the non-woven portion corresponds to a sacrificial zone of the warp yarns.

BRIEF DESCRIPTION OF THE DRAWINGS

Other characteristics and benefits of the invention appear from the following description of particular embodiments of the invention given as non-limiting examples and with reference to the accompanying drawings, in which.

DETAILED DESCRIPTION

The invention applies in general manner to making fiber structures suitable for constituting fiber reinforcement, or preforms, for fabricating composite material parts, the parts being obtained by densifying fiber structures with a matrix. The matrix is typically a resin for composite materials that are used at temperatures that are not very high, typically up to 300° C., or else it is a refractory material such as carbon or a ceramic for thermostructural composites.

The fiber structure of the invention is obtained by three-dimensional weaving or by multilayer weaving.

The terms "three-dimensional weaving" or "3D weaving" are used herein to mean weaving in which at least some of the weft yarns link together warp yarns over a plurality of warp layers, or vice versa. 3D weaving may be of the interlock type, as described in Document WO 2006/136755.

The term "multilayer weaving" is used herein to specify 3D weaving with a plurality of warp layers in which the base weave of each layer is equivalent to a conventional 2D weave, such as a plain, satin, or serge type weave, but with certain points of the weave interlinking warp layers or vice versa.

Making the fiber structure by 3D weaving or multilayer weaving enables layers to be linked together in a single textile operation, and thus makes it possible to have good mechanical cohesion for the fiber structure and for the resulting composite material part.

Figure 1:
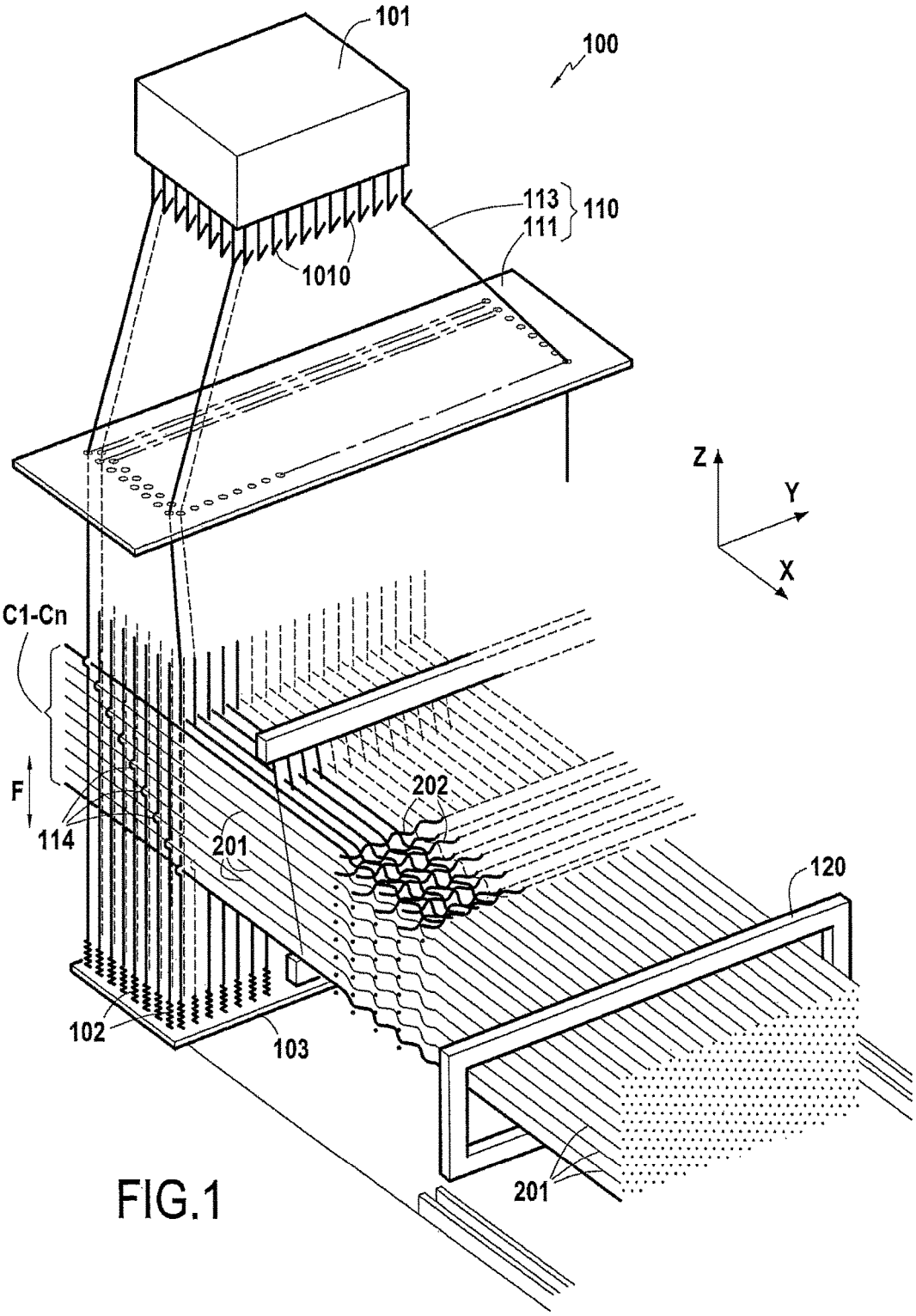
FIG. 1 is a diagrammatic perspective view of a Jacquard type loom.
Figure 2:
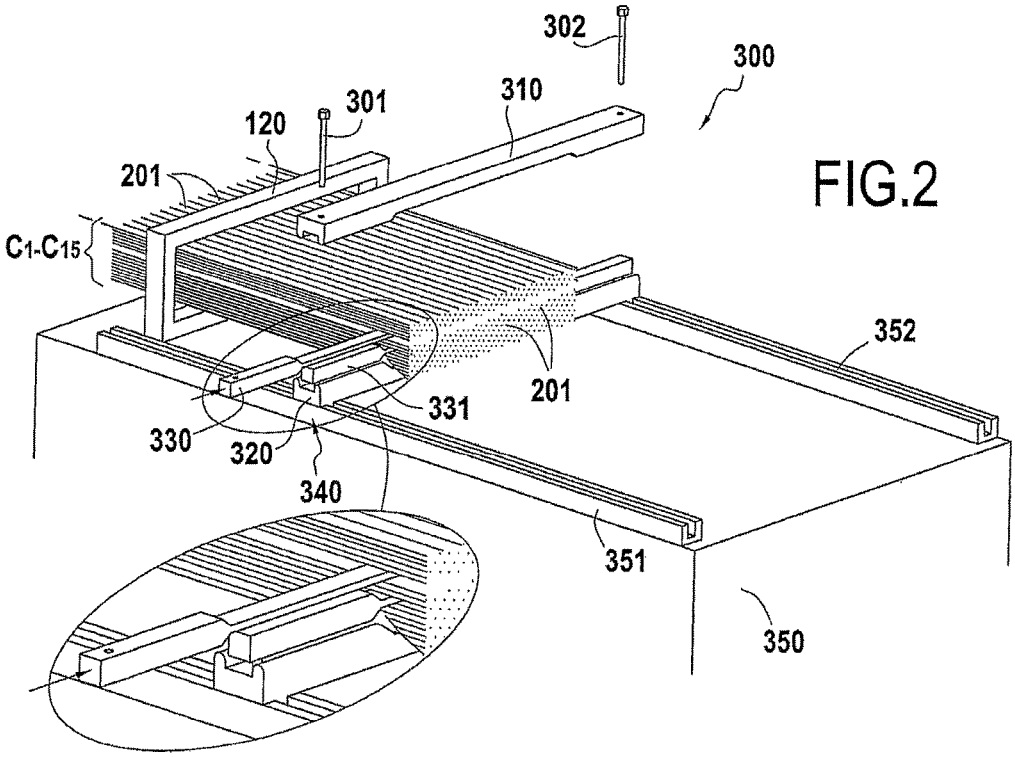
FIG. 2 is a diagrammatic perspective view of a warp yarn take-up system in accordance with an embodiment of the invention showing how the clamping device of the system being assembled.

FIG. 1 shows a loom 100 fitted with a Jacquard mechanism 101 supported by a superstructure that is not shown in FIG. 2. The loom 100 also has a harness 110 constituted by a comber board 111 and control yarns or heddles 113, each heddle 113 being connected at one end to a control hook 1010 of the Jacquard mechanism 101 and at its other end to a corresponding return spring 102 fastened to the stand 103 of the loom 100. Each heddle 113 has an eyelet 114 with a warp yarn 201 passing therethrough. The heddles 113 and their associated eyelets 114 lie in a zone in which the heddles 113 and the eyelets 114 are caused to perform substantially vertical oscillating movements represented by double-headed arrow F. The heddles 113 are subjected to traction forces exerted respectively by the control hooks 1010 and by the return springs 102. The heddles 113 serve to lift certain warp yarns 201 in compliance with a defined weaving program. By lifting certain warp yarns 201, the heddles 113 thus create a shed enabling weft yarns 202 for 3D or multilayer weaving of the fiber structures to be inserted. The warp yarns 201 are organized as a plurality of warp yarn layers $C_1$ to $C_n$.

The warp yarns 201 are taken from bobbins arranged on a creel (not shown in FIG. 1) upstream from the Jacquard mechanism 101 of the loom 100. For this purpose, and as shown in FIG. 2, a warp yarn take-up system 300 is associated with the loom 100, downstream therefrom. The frame 120 defines the outlet from the loom 100, i.e. the zone from which the warp yarns 201 are no longer woven with weft yarns 202. The warp yarn take-up system 300 comprises a clamping device 340 constituted in this example by a top clamp 310, a bottom clamp 320, and intermediate clamping elements 330 and 331 for holding sets of warp yarn layers $C_1$ to $C_{15}$ downstream from the loom 100 by clamping them together. Each of the bottom and top clamps 310, 320 and the intermediate clamping elements 330 and 331 extends over a distance that is longer than the width of the warp yarn layers $C_1$ to $C_{15}$. In accordance with an embodiment of the invention, the intermediate clamping elements 330 and 331 are for inserting between two adjacent layers of warp yarns, with it being possible for one or more warp yarn layers to be present between two intermediate clamping elements 330, 331 or between one of the clamps 310 or 320 and an intermediate clamping element 330, 331. The intermediate clamping elements 330 and 331 are clamped between the clamps 310 and 320 at the same time as the warp yarn layers $C_1$ to $C_{15}$.

There follows a description of a weaving method in accordance with an implementation of the invention. FIG. 2 shows the first step of the method, which consists in putting the clamping device 340 of the warp yarn take-up system 300 into place before beginning to weave a plurality of fiber textures from a plurality of layers $C_1$ to $C_{15}$ of warp yarns 201 that are interlinked by weft yarns using three-dimensional or multilayer weaving that is performed in the above-described loom 100. In accordance with the invention, the weaving program is configured to control the movement of the heddles 113 in such a manner as to move warp yarn layers away from other warp yarn layers in order to enable the intermediate clamping elements 330 and 331 to be inserted between two adjacent layers of warp yarns. In the presently-described example, 15 warp yarn layers $C_1$ to $C_{15}$ are used for weaving fiber structures, whereas two intermediate clamping elements 330 and 331 are used together with the clamps 310 and 320. The weaving program controls the movement of the heddles 113 so as to open the shed of warp yarns between the layers $C_5$ and $C_6$ for inserting the intermediate clamping element 330, and between the yarns $C_{10}$ and $C_{11}$ for inserting the intermediate clamping element 331. Thus, the layers $C_1$ to $C_5$ are located between the top clamp 310 and the intermediate clamping element 330, the yarns $C_6$ to $C_{10}$ are located between the two intermediate clamping elements 330 and 331, and the layers $C_{11}$ to $C_{15}$ are located between the intermediate clamping element 331 and the clamp 320 (FIG. 9).

Figure 3:
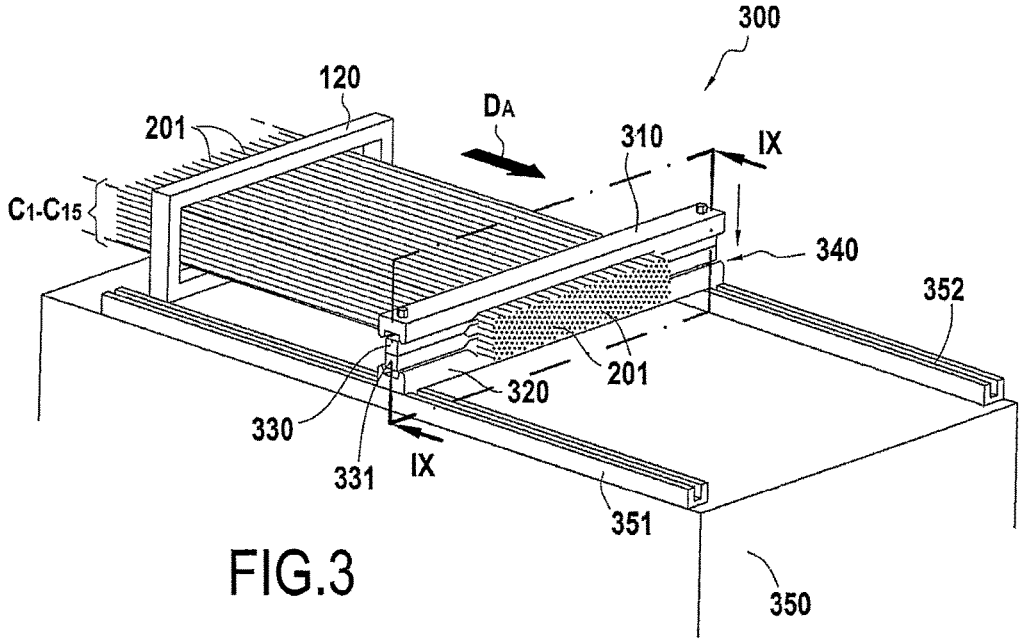
FIG. 3 is a diagrammatic perspective view of the FIG. 2 warp yarn take-up system at the beginning of weaving a first fiber structure.

Once the intermediate clamping elements 330 and 331 have been inserted between the warp yarn layers, as described above, the clamps 310 and 320 are clamped together, in this example by means of clamping members 301 and 302, so as to hold together all of the warp yarn layers $C_1$ to $C_{15}$ in the clamping device 340 (FIG. 3).

Figure 9:
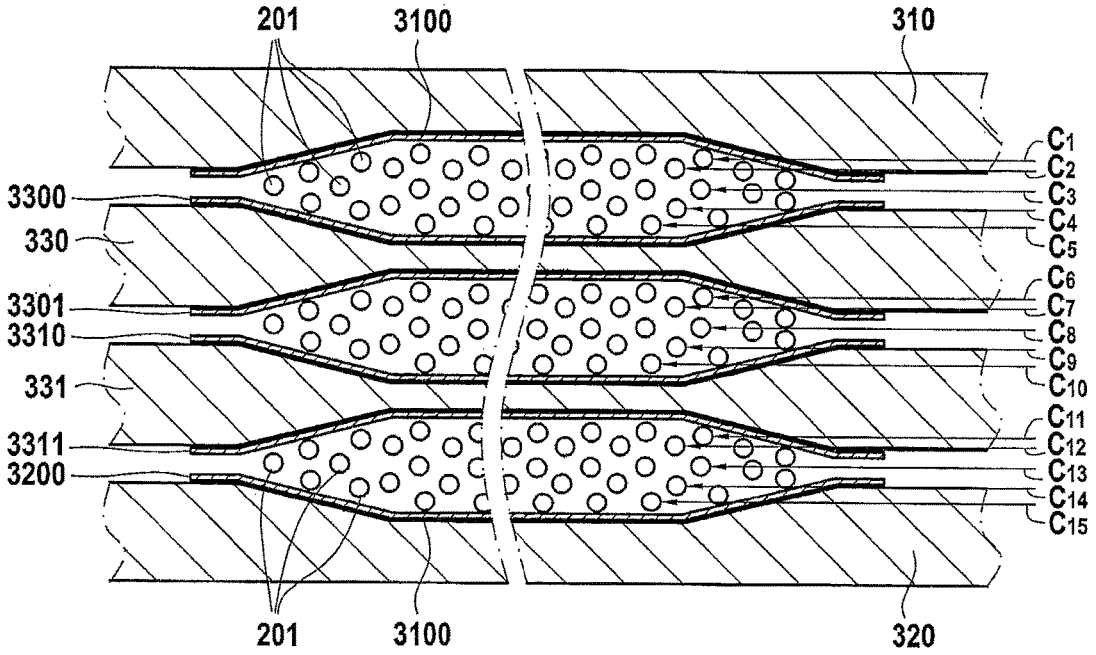
FIG. 9 is a section view on section plane IX-IX of FIG. 3.
Figure 10:
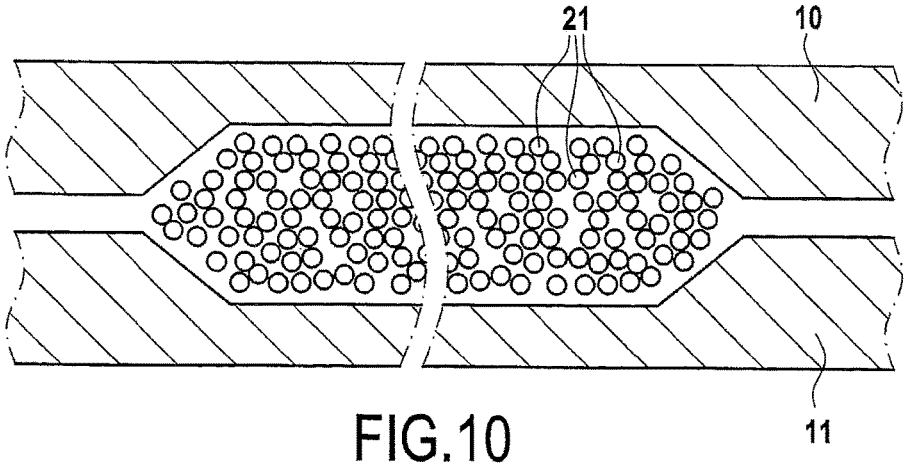
FIG.10 PRIOR ART
FIG. 10 is a section view showing prior art warp yarn clamping.

As shown in FIG. 9, by reducing the number of warp layers that are held (clamped) together between two clamps (bottom/top clamp and/or intermediate clamping element), any risk of relative sliding between the warp yarns of the various layers is minimized, thereby making it possible to conserve the overall initial organization of the warp yarns as defined in the harness of the loom. Since the warp yarns are taken up while complying with the organization of the warp yarn layers as initially defined in the harness, this improves the quality of the woven preforms.

Figure 4:
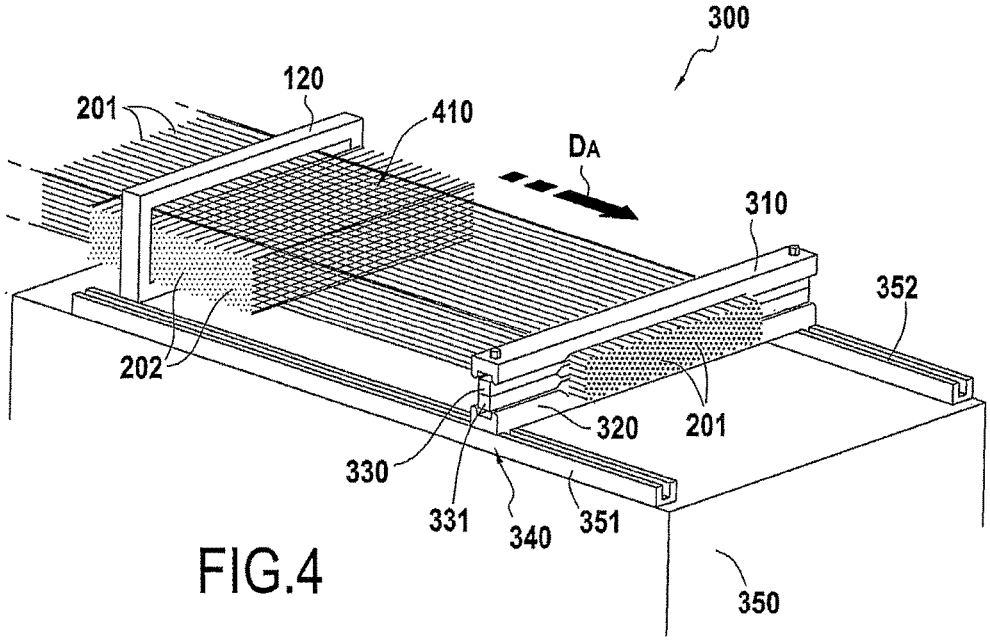
FIG. 4 is a diagrammatic perspective view of the FIG. 3 warp yarn take-up system after weaving the first fiber structure.

Once all of the warp yarns of the layers $C_1$ to $C_{15}$ are clamped between the clamps 310, 320 and the intermediate clamping elements 330, 331 of the clamping device 340, the weaving of a first fiber structure 410 can be begun by the loom 100 (FIGS. 3 and 4). While the fiber structure 410 is being woven, the warp yarns 201 are advanced in the advance direction $D_A$ by the clamping device. More precisely, in the presently-described example, the bottom clamp 320 is mounted on rails 351 and 352 of a stand 350 of the warp yarn take-up system 300 so as to enable the clamping device 340 to be moved. The clamping device 300 is moved by a motor, e.g. a stepper motor (not shown in FIGS. 3 and 4). Each time a column of weft yarns 202 has been fully woven with the warp yarn layers $C_1$ to $C_{15}$, the clamping device 340 is driven in the direction $D_A$ over a distance enabling the following weft column to be inserted and woven in the loom 100.

Figure 5:
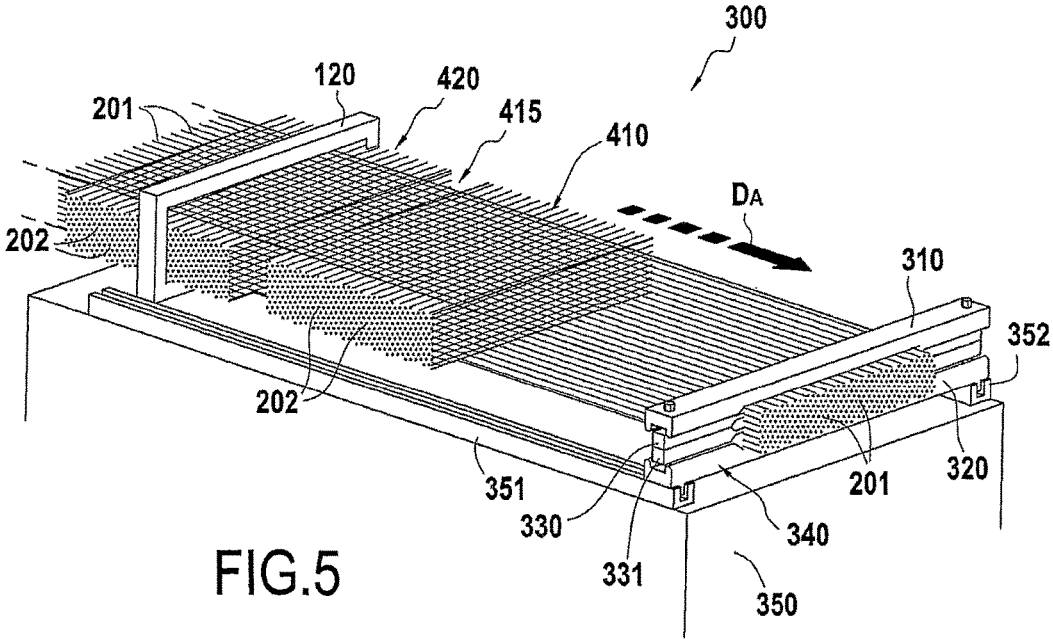
FIG. 5 is a diagrammatic perspective view of the FIG. 4 warp yarn take-up system after beginning to weave a second fiber structure.
Figure 6:
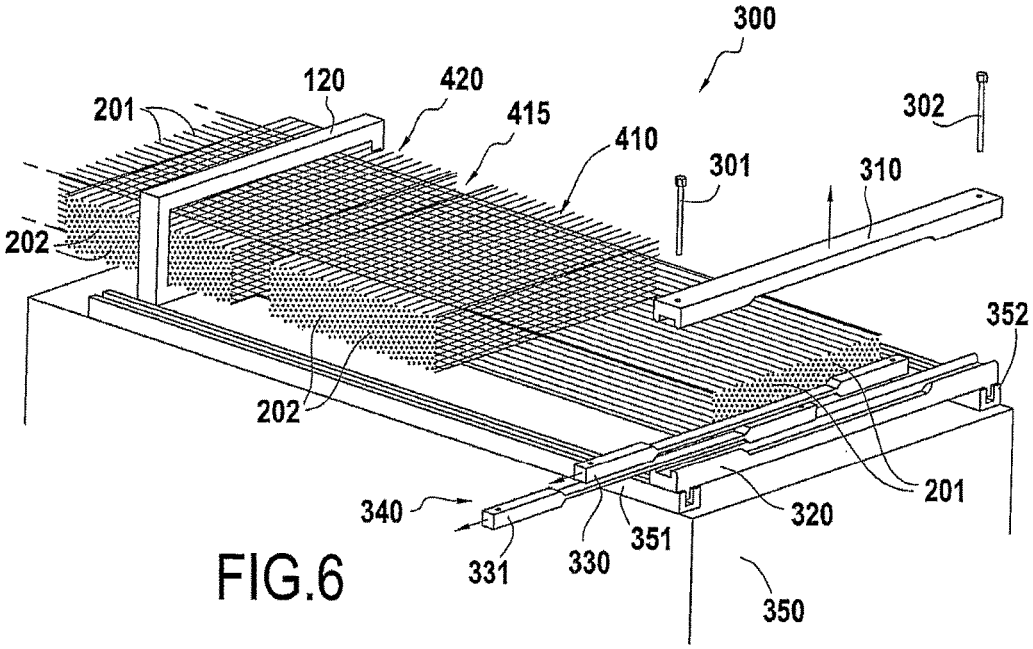
FIG. 6 is a diagrammatic perspective view of the FIG. 5 warp yarn take-up system showing the clamping device being disassembled.
Figure 7:
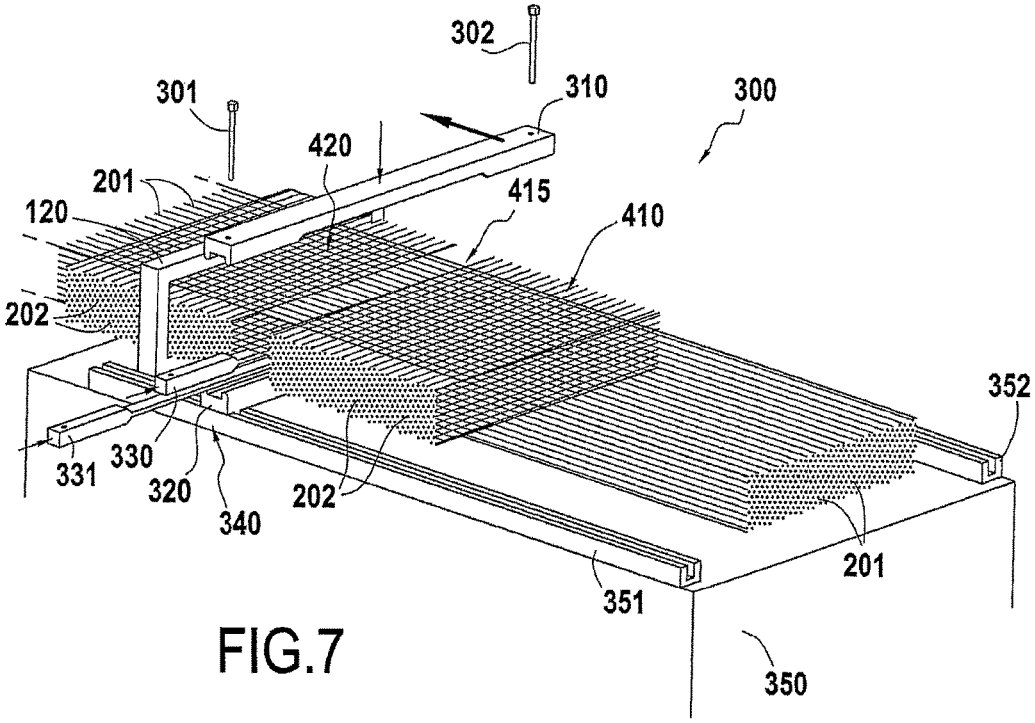
FIG. 7 is a diagrammatic perspective view of the FIG. 6 warp yarn take-up system showing the clamping device being assembled between the first and second fiber structures.

Once the first fiber structure 410 has been woven, a second fiber structure 420 is woven, the second structure 420 being separated from the structure 410 by a portion 415 of warp yarns 201 that are not woven with weft yarns (FIG. 5). Once the portion 415 lies outside the loom 100, i.e. beyond the frame 120, the clamping device 340 is held stationary and weaving in the loom is stopped. Thereafter, the clamping device 300 is disassembled (FIG. 6) in order to be reassembled on the portion 415 situated between the first and second fiber structures 410, 420 (FIG. 7). The warp yarn layers $C_1$ to $C_{15}$ are shared between the elements of the clamping device 340 (bottom and top clamps 310 and 320 and intermediate clamping elements 330 and 331) in the same manner as described above.

Figure 8:
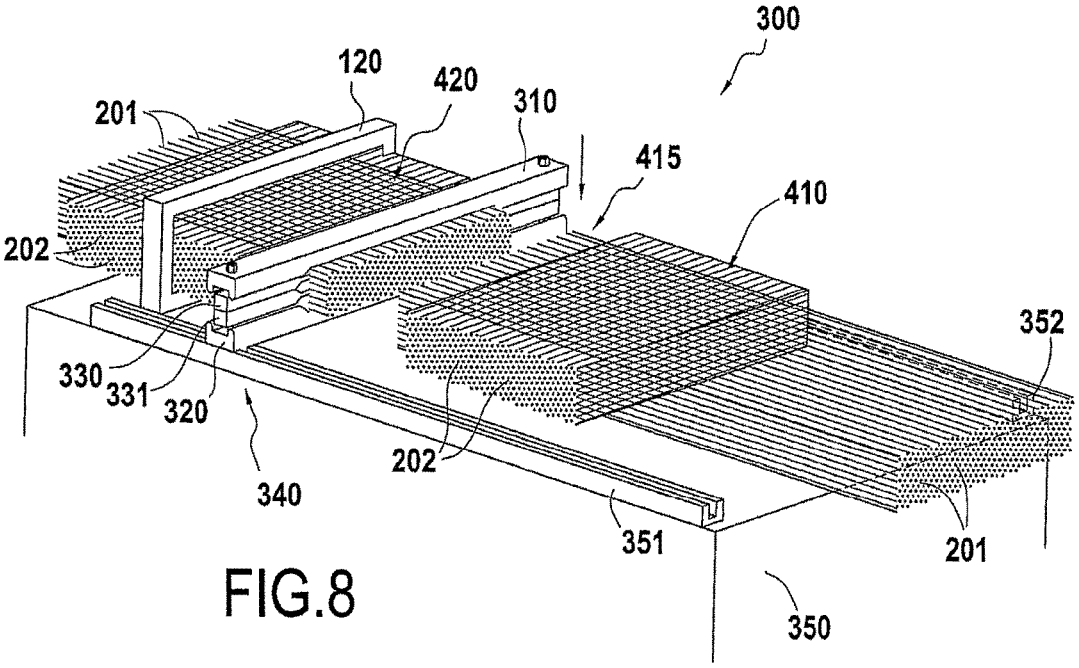
FIG. 8 is a diagrammatic perspective view of the FIG. 7 warp yarn take-up system showing the first fiber structure being extracted.

Once all of the warp yarn layers $C_1$ to $C_{15}$ are held in the clamping device 340, the warp yarns 201 present in the portion 415 downstream from the clamping device 340 are cut in order to extract the first fiber structure 410 (FIG. 8).

Thereafter, the clamping device is put back into movement while at the same time weaving is restarted in the loom 100 so as to continue weaving the second fiber structure 420. The above-described operations are repeated for all of the other fiber structures that are to be woven.

According to a particular characteristic of the invention, the portions of the clamps and of the intermediate clamping elements that are to come into contact with the warp yarns are covered in respective layers of soft material such as elastomer layers. As shown in FIG. 9, the face of the top clamp 310 facing the warp yarns has an elastomer layer 3100, while the face of the bottom clamp 320 facing the warp yarns has an elastomer layer 3200. Likewise, the intermediate clamping element 330 has respective elastomer layers 3300 and 3301 on both of its faces facing warp yarns, while the intermediate clamping element 331 has respective elastomer layers 3310 and 3311 on both of its faces facing warp yarns. The layer of soft material serves to avoid damaging the warp yarns while they are being clamped, and also serves to fit closely to the shape of the fiber structure so as to facilitate clamping.

The invention claimed is:

1. A warp yarn take-up system comprising a clamping device for holding a plurality of layers of warp yarns, the clamping device being movable at least in a direction corresponding to an advance direction of the warp yarns, wherein the clamping device comprises a bottom clamp, a top clamp, and at least one intermediate clamping element present between the bottom clamp and the top clamp, and wherein the bottom clamp, the top clamp, and the at least one intermediate clamping element are held together by clamping.

2. The system according to claim 1, wherein the bottom clamp, the top clamp, and the at least one intermediate clamping element include one or more portions for coming into contact with the warp yarns during clamping of the clamping device, and wherein each portion is covered in a layer of soft material.

3. The system according to claim 2, wherein the soft material is selected from at least of the following materials: elastomer, rubber, silicone, copolymer.

4. A Jacquard type loom, including a warp yarn take-up system according to claim 1.

5. A method of fabricating at least one fiber structure by three-dimensional or multilayer weaving between a plurality of layers of warp yarns interlinked by weft yarns, the method comprising:

clamping warp yarn layers by clamping a clamping device of a warp yarn take-up system, the clamping device being movable at least in a direction corresponding to an advance direction of the warp yarns, wherein the clamping device comprises a bottom clamp, a top clamp, and at least one intermediate clamping element present between the bottom clamp and the top clamp, and wherein the bottom clamp, the top clamp, and the at least one intermediate clamping element are held together by clamping, each intermediate clamping element being inserted between two adjacent layers of the plurality of warp yarn layers so as to separate a fraction of the warp yarn layers in the plurality of warp yarn layers from the remaining layers of the plurality of warp yarn layers in the clamping device; and weaving a first fiber structure upstream from the clamping device, said clamping device being moved in the advance direction of the warp yarns during the weaving.

6. The method according to claim 5, wherein a second fiber structure is woven using the same plurality of weft yarn layers as is used in the first fiber structure, a non-woven portion of warp yarns lying between the two fiber structures, and wherein the clamping device is put into place on the non-woven portion.

7. The method according to claim 6, wherein the warp yarns situated downstream from the clamping device are cut so as to extract the first fiber structure.

8. The system according to claim 1, wherein the at least one intermediate clamping element is provided between the top clamp and the bottom top so as to separate a fraction of the warp yarn layers in the plurality of warp yarn layers from the remaining layers of the plurality of warp yarn layers in the clamping device.

9. The system according to claim 1, wherein the at least one intermediate clamping element is provided between two adjacent layers of the plurality of warp yarn layers.

10. The system according to claim 1, wherein the bottom clamp is mounted on at least one rail so as to enable the clamping device to be moved.

* * * * *